US011648460B1

(12) United States Patent
Esposito et al.

(10) Patent No.: US 11,648,460 B1
(45) Date of Patent: May 16, 2023

(54) MEMORY PUZZLE AND METHODS THEREOF

(71) Applicant: Creative Brainworks, LLC, Sparta, NJ (US)

(72) Inventors: Anthony Esposito, Sparta, NJ (US); Philipp Elliott, Huntersville, NC (US); Corey Wilcox, Wayne, MI (US); Edward Packer, Murray, UT (US); Aaron Nelson, Salt Lake City, UT (US)

(73) Assignee: Creative Brainworks, LLC, Sparta, NJ (US)

( * ) Notice: Subject to any disclaimer, the term of this patent is extended or adjusted under 35 U.S.C. 154(b) by 0 days.

(21) Appl. No.: 17/182,231

(22) Filed: Feb. 22, 2021

Related U.S. Application Data

(60) Provisional application No. 62/979,430, filed on Feb. 21, 2020.

(51) Int. Cl.
*A63F 9/08* (2006.01)

(52) U.S. Cl.
CPC .... *A63F 9/0826* (2013.01); *A63F 2009/0846* (2013.01)

(58) Field of Classification Search
CPC ..... A63F 9/0826; A63F 2009/0846; A63F 9/083; A63F 2250/24; A63F 2009/0815; A63F 9/0811; E05B 37/20; E05B 41/00; E05B 63/0047; E05B 13/103; E05B 37/02
See application file for complete search history.

(56) References Cited

U.S. PATENT DOCUMENTS 430,261 A * 6/1890 Altemus, Jr. ..... E05B 37/02 70/312
1,833,793 A * 11/1931 Pfleger ..... G09B 17/00 273/281
2,411,717 A * 11/1946 Fay ..... G09B 1/20 434/174
3,407,514 A * 10/1968 Christian ..... G09B 17/00 D19/64
3,421,347 A * 1/1969 Sotory ..... B65D 55/145 70/63
3,574,957 A * 4/1971 Bello-Bridick .... A47G 19/2227 434/173
4,632,399 A * 12/1986 Bern ..... A63F 9/0811 273/155
4,902,230 A * 2/1990 Jones ..... G09B 1/20 434/174
4,949,969 A * 8/1990 Johnson ..... A63F 9/001 273/153 R (Continued)

FOREIGN PATENT DOCUMENTS

CA 1199351 A * 1/1986 ..... A63F 9/083
CA 2072554 A1 * 12/1993 ..... A63F 9/083

(Continued)

*Primary Examiner* — Steven B Wong
(74) *Attorney, Agent, or Firm* — Michael P. Kochka, Esq.

(57) ABSTRACT

A memory puzzle is provided that may include one or more levels of rotatable level housing, a number of puzzle spaces disposed on the rotatable level housings, and a piston for indicating that a portion of the puzzle has been solved, wherein the piston raises to a high level as levels of the puzzle are solved, wherein the puzzle is solved when a code is achieved by rotating the rotatable level housings in a specific pattern.

4 Claims, 26 Drawing Sheets

(56) References Cited

U.S. PATENT DOCUMENTS 5,074,561 A * 12/1991 Johnson ..... A63F 9/001 273/153 S
5,083,788 A * 1/1992 Conotter ..... A63F 9/083 273/153 S
5,116,053 A * 5/1992 Blankenburg ..... A63F 9/0811 273/153 S
5,148,692 A * 9/1992 Gieseker ..... A63F 9/0078 273/156
5,259,619 A * 11/1993 Rosewarne ..... A63F 9/0078 273/153 R
D342,547 S * 12/1993 Putman ..... D19/64
5,429,364 A * 7/1995 Chang ..... A47G 19/2227 273/153 S
5,884,912 A * 3/1999 Ignatiev ..... A63F 9/0078 273/153 S
7,107,803 B1 * 9/2006 Swanson ..... E05B 37/02 70/163
7,252,204 B1 * 8/2007 Small ..... B65D 55/145 206/459.5
7,275,744 B1 * 10/2007 Kuo ..... A63F 9/001 273/153 S
8,251,366 B1 * 8/2012 Nathan ..... A63F 9/0811 273/153 S
8,302,967 B2 * 11/2012 Kim ..... A63F 9/083 273/153 S
8,398,080 B2 * 3/2013 Stolten ..... A63F 9/1204 434/188
11,007,425 B2 * 5/2021 Chan ..... A63F 9/0869
2003/0155709 A1 * 8/2003 Han ..... A63F 9/083 273/153 S
2003/0227131 A1 * 12/2003 Han ..... A63F 9/083 273/153 S
2005/0278186 A1 * 12/2005 de la Huerga ..... A63F 9/18 705/25
2005/0288082 A1 * 12/2005 de la Huerga ..... A63F 9/0811 463/9
2006/0061033 A1 * 3/2006 Han ..... A63F 9/083 273/153 S
2006/0175752 A1 * 8/2006 Chuang ..... A63F 9/083 273/153 S
2006/0279041 A1 * 12/2006 Lammertink ..... A63F 9/0838 273/153 S
2011/0057387 A1 * 3/2011 Yang ..... A63F 9/0865 273/153 S
2015/0238852 A1 * 8/2015 Perkins ..... A63F 9/06 273/153 S
2020/0094132 A1 * 3/2020 Singh ..... A63F 9/0811

FOREIGN PATENT DOCUMENTS

DE 3309674 A1 * 9/1984 ..... A63F 9/083
DE 9418690 U1 * 2/1995 ..... A63F 9/083
FR 2521023 A1 * 8/1983 ..... A63F 9/0811
GB 2107997 A * 5/1983 ..... G09D 3/06
SU 1319888 A1 * 6/1987 ..... A63F 9/083
WO WO-0045912 A1 * 8/2000 ..... A63F 9/083

* cited by examiner

114

114

114

116

116

116

MEMORY PUZZLE AND METHODS THEREOF

CROSS-REFERENCE TO RELATED APPLICATIONS

The present application claims priority to U.S. Provisional Patent Application Ser. No. 62/979,430 entitled "MEMORY PUZZLE AND METHODS THEREOF," filed Feb. 21, 2020, the disclosure of which is incorporated herein by reference in its entirety.

BACKGROUND

Field of the Invention

Embodiments of the present invention are generally related to a memory puzzle and methods thereof. More specifically, embodiments of the present invention relate to a puzzle with a combination code solution and a piston for indicating at least a portion of the puzzle has been solved. The puzzle solution may be set at various levels of difficulty and may be reset for multiple puzzle challenges, allowing for round after round of fun.

Description of the Related Art

Puzzles have been used to challenge the intellect for many centuries. As our awareness of the world surrounding us has grown over the decades, so too has the sophistication of puzzles. There are many puzzles that have been patented by inventors. Indeed, many puzzles have been used both as building blocks but also as educational tools for young persons. Such puzzles are shown in patents, but also in the general public's consciousness.

A wide variety of puzzles and puzzle devices are available, including both mechanical and electronic puzzles. In such puzzles, the user manipulates the puzzle to achieve a desired result or to solve a problem. The Rubik's Cube® is an example of such a puzzle, wherein the user is required to rotate portions of a cube that are each made up of smaller cubes having differently colored sides. The objective of Rubik's Cube® is to manipulate the cube in a matter that results in a desired pattern of colors, the simplest being a single color on each side of the cube.

Embodiments of the present disclosure elevate the art of puzzles to a different level with the ability to challenge a person's intellect. Embodiments of the present disclosure are useful in refining and sharpening memory skills and as an educational tool for young persons and adults alike.

SUMMARY

Embodiments of the present disclosure generally relate to a memory puzzle. A memory puzzle is provided that may include one or more levels of rotatable level housing, a number of puzzle spaces disposed on the rotatable level housings, and a piston for indicating that a portion of the puzzle has been solved, wherein the piston raises to a high level as levels of the puzzle are solved, wherein the puzzle is solved when a code is achieved by rotating the rotatable level housings in a specific pattern.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
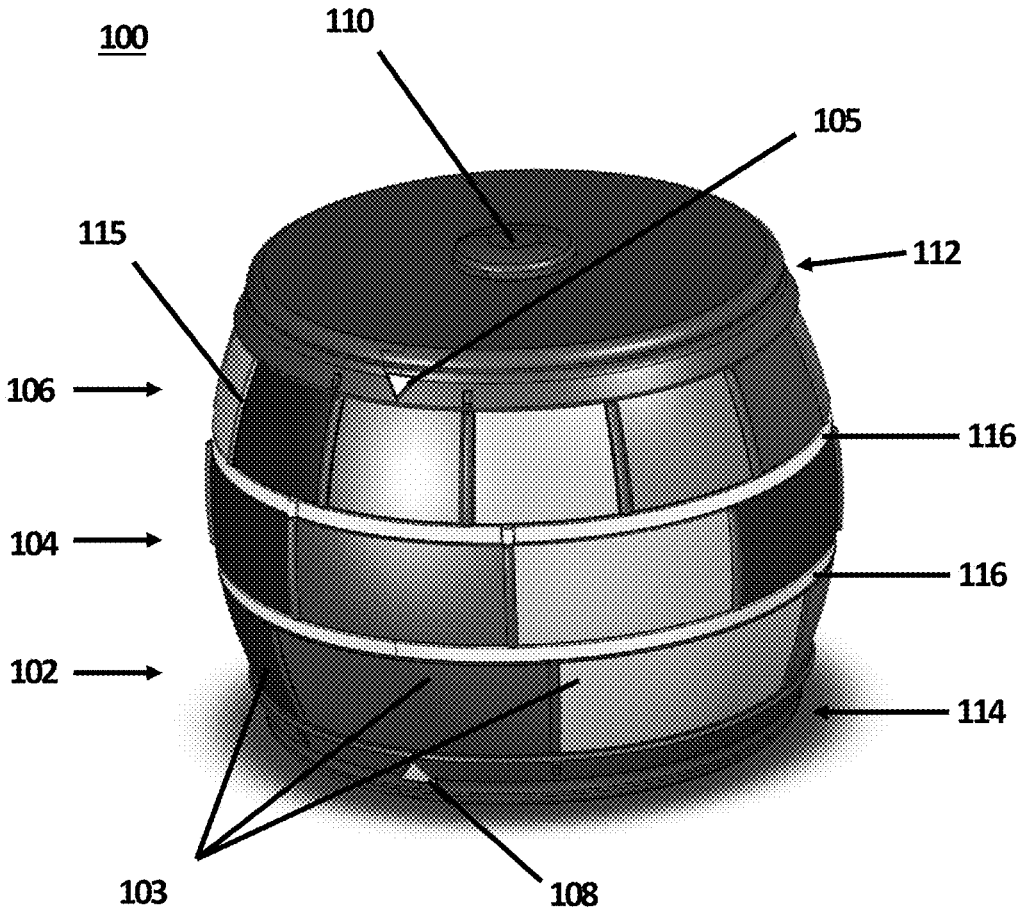
FIG. 1 depicts a top perspective view of a memory puzzle in accordance with embodiments of the present disclosure.
Figure 2:
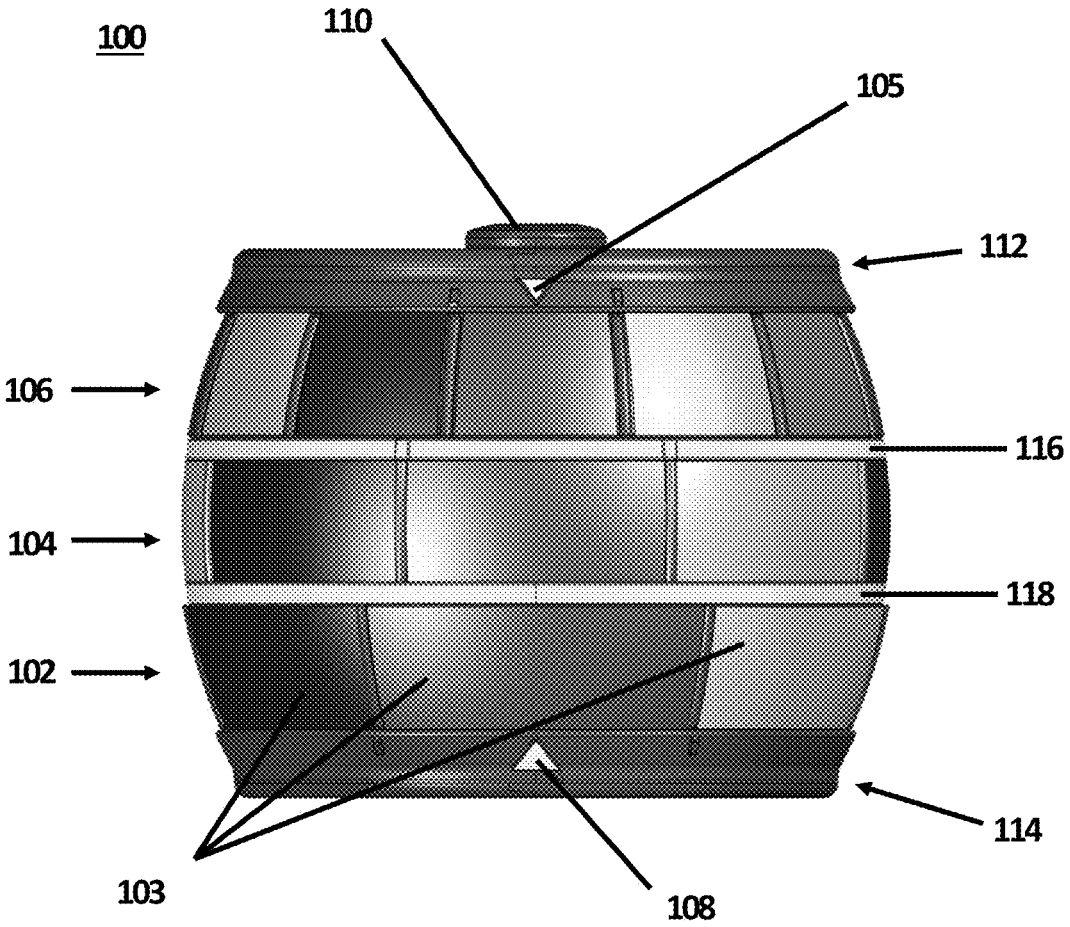
FIG. 2 depicts a front view of the memory puzzle depicted in FIG. 1.
Figure 3:
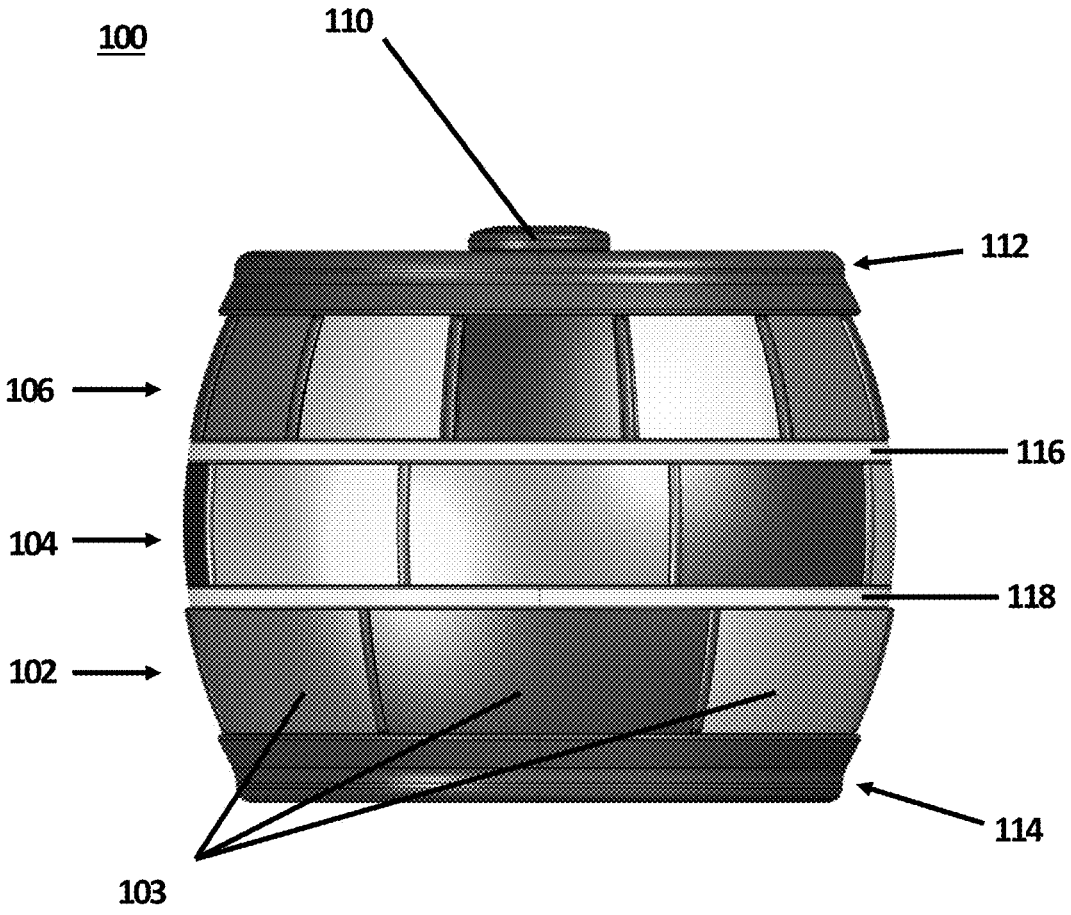
FIG. 3 depicts a back view of the memory puzzle depicted in FIG. 1.
Figure 4:
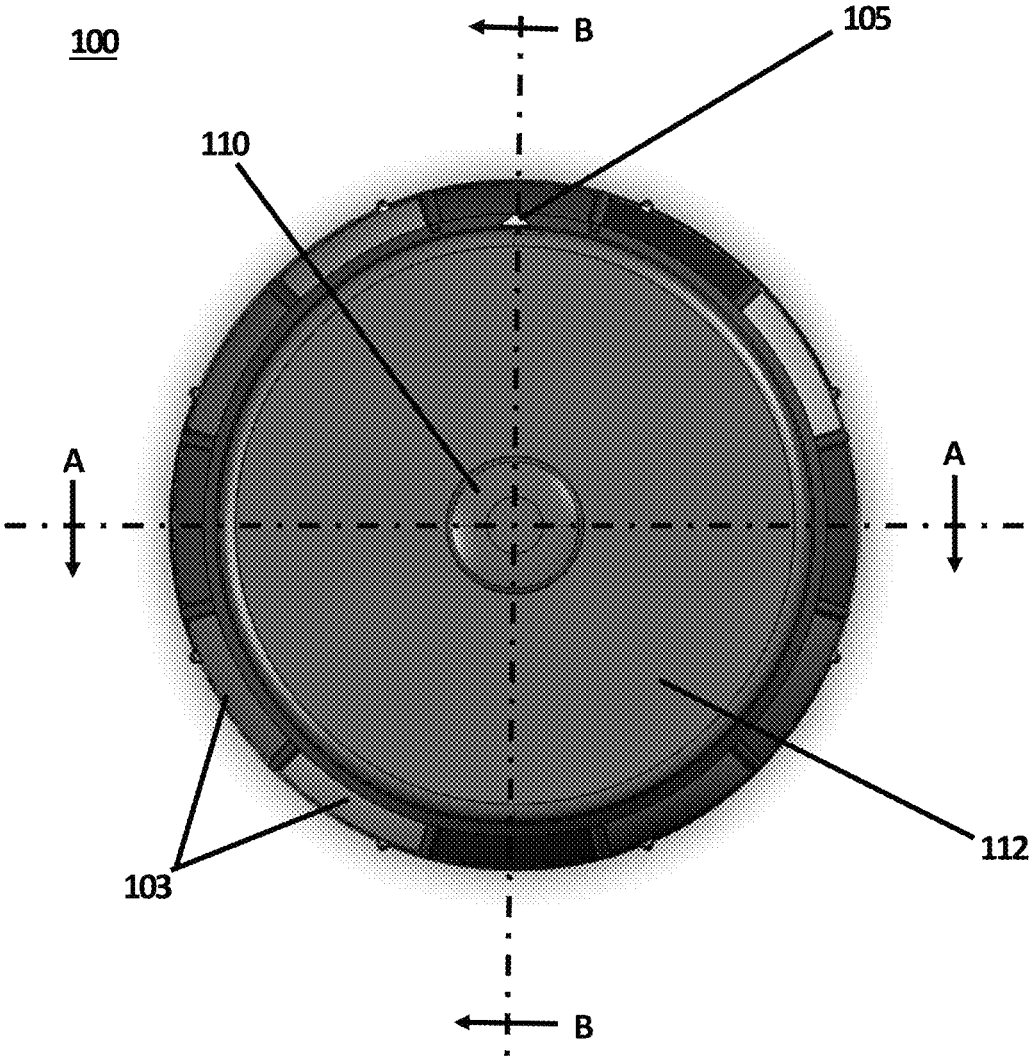
FIG. 4 depicts a top view of the memory puzzle depicted in FIG. 1.
Figure 5:
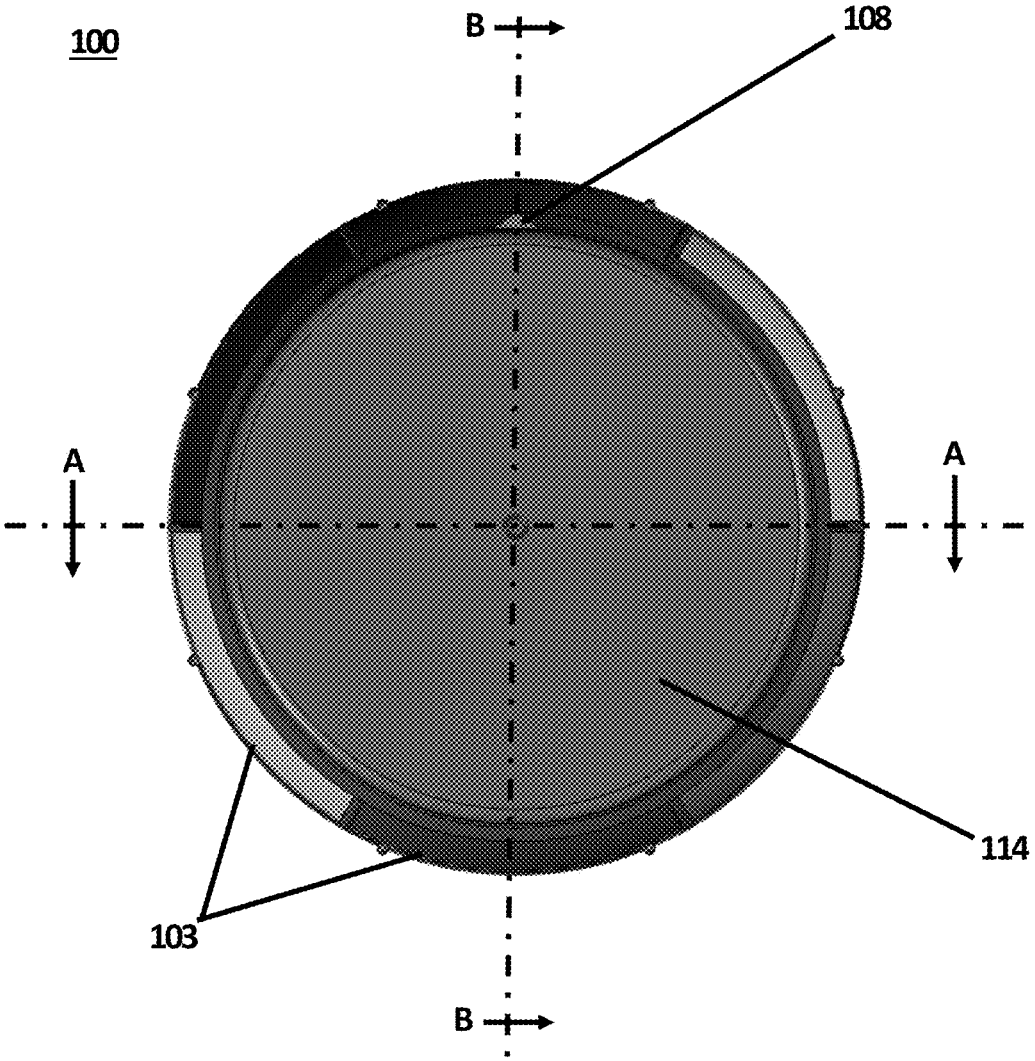
FIG. 5 depicts a bottom view of the memory puzzle depicted in FIG. 1.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention are generally related to a memory puzzle and methods thereof. More specifically, embodiments of the present invention relate to a puzzle with a combination code solution and a piston for indicating at least a portion of the puzzle has been solved. The puzzle solution may be set at various levels of difficulty and may be reset for multiple puzzle challenges, allowing for round after round of fun.

The memory puzzles disclosed herein may include a brain-teasing mind puzzle game that offers vast possibilities and endless fun with its addictive color-spinning and fidget challenges. By enticing users to unlock the code to one of its thousands of color combinations, memory puzzles disclosed herein may enhance memory, critical thinking skills and test IQ.

Memory puzzles in accordance with embodiments of the present disclosure may challenge users to "crack the code," to solve the puzzle. The "code" may be the solution to the puzzle. In some embodiments, the code may a number of three-color code solutions. For example, in the embodiments depicted in the figures, a set of three, three-color code solutions are required to "crack the code" and solve the puzzle. Although three colors are used as an example, it is contemplated that more or less than three colors may be used. For example, two, four, or five color solutions may be used. Colors are also used as an example herein. It is contemplated that instead of or in addition to colors, symbols, numbers, letters, pictures, words, or other indicators may be used to indicate a particular position on the memory puzzle.

In some embodiments of the present disclosure, a memory puzzle may comprise three levels of difficulty with the easiest level having six colors, the intermediate level having eight colors, and an advanced level having twelve colors to work through in solving the code to crack the color combination. It is contemplated that additional or fewer levels and/or colors per each level may be included in a memory puzzle in accordance with exemplary embodiments. To attempt to solve the puzzle, the user may rotate the color selections and attempt to "crack" the solution by finding the three-color combination configured as the solution to the puzzle. A special piston may pop up when each level is solved, rewarding the player and notifying them that they have solved that level and cracked the code. When setting up the game, players may reset each of color combinations or code for each level to a specific code or random code to try and crack. A memory puzzle in accordance with exemplary embodiments may challenge a user's mind. In accordance with exemplary embodiments, to reset the code to crack, users are presented with the option to reset their color code combination to a random code or a code specified by the user. Puzzles in accordance with embodiments of the present disclosure may include hundreds of thousands of combination possibilities and hours of challenges for the user.

In some embodiments, the code is unlocked by a secret three-color combination. Each difficulty level may correspond to a row of colors on the puzzle unit. To start, the user holds puzzle unit with the level 3 row facing their left hand and the level 1 row facing their right hand with the white arrows on top. Then, the user may rotate level 1 two times clockwise and move to their first selected color. From there, the user may rotate level 1 counterclockwise one full rotation, and then move to their second color choice. Then rotate level 1 clockwise by going directly to their final color choice. If the user cracks the code, a piston on top of the puzzle unit will pop up one level. Then, the user may move onto unlocking level two and level three. Once the user has solved all levels, the user can reset the code and even create their own code solution.

In accordance with exemplary embodiments of the present disclosure a puzzle may be set up for levels of combinations to be solved. For example, the puzzle may comprise one, two, three, four, or five levels, or the like. In some embodiments, there may be three different levels, wherein each level would need to be solved by the user before the next level can be solved. As each level of the puzzle is solved, the piston may raise up to signify that a level of the puzzle has been solved. The game may be played until all levels of the game are solved. In a three-level example, once the third level, which may be the most challenging level, is solved the complete puzzle may be considered solved.

In some embodiments, once the puzzle is solved, a portion of the puzzle may then unlock, or the like, allowing the user to disassemble or take apart the puzzle to set each level of the puzzle. This portion of the puzzle may only unlock upon solving of the complete puzzle or in many embodiments it may unlock at any time, allowing the user to set a custom solution or reset the solution to a different solution unknown to the user.

Each level of the puzzle may comprise a dial. After the puzzle is solved, the puzzle may be able to be taken apart to reset the correct puzzle answer for each dial by resetting tumblers/combination, and/or the like. When the new answers for each level and a new combination is set, the user may put the puzzle back together for another round of endless challenges and fun.

In some embodiments, each level may comprise a disc that rotates in a way similar to a single-dial combination lock. In order to solve the puzzle, a user would need to reset the dials by turning it in a first direction (e.g., clockwise) three times and may stop when a first puzzle indicator, which may comprise a color, a symbol, a number, and/or the like) is aligned with a stopping point indicator on the puzzle. The dial would then be turned back in a second direction (e.g., counterclockwise) past the first puzzle indicator and until a second puzzle indicator (which, in some embodiments, may be the same indicator as the first puzzle indicator) aligns with a stopping point indicator. Lastly, the dial may be turned back in the first direction (e.g., clockwise) until a third puzzle indicator is aligned with a stopping point indicator. If all three puzzle indicators are correctly chosen by the user, a piston may raise up to signify a level of the puzzle has been solved. The user may continue turning each of the levels or dials until the correct combination of puzzle indicators are chosen for each level. Once the correct combination of puzzle indicators is chosen and selected using the method described above, or the like, the piston may raise for a final time indicating the puzzle has been solved. When the puzzle has been solved the user may disassemble the puzzle in order to change the answer or combination for each level or dial of the puzzle. The puzzle may then be reassembled, and a user may again attempt to solve the puzzle. In some embodiments, after the puzzle has been solved, the puzzle may automatically and/or randomly reset the correct combination for each level or dial of the puzzle so that the user is unaware of the answer prior to beginning the puzzle. In some embodiments, each level may appear to the user to be solved in a similar way to a dial combination lock, however the components and mechanisms on the interior may differ from the interior components and mechanisms of a dial combination lock.

In accordance with embodiments of the present disclosure, a mind puzzle may be provided that creates endless challenges with unique combinations to solve the problem by rotating the rows of colors, or the like, and working to identify the correct combination to unlock the piston for each of the levels or tiers. Puzzles in accordance with embodiments of the present disclosure may enable users to use and sharpen their short-term memory skills to work through a challenging multi-tiered puzzle.

In one example, in order to solve the puzzle a user may need to identify a correct three-color combination within a first row/tier or level one. Once the correct three-color combination is identified the piston may raise up to signify that level was solved. The user may then need to work through a middle row tier to identify the correct three-color combination. Once the correct three-color combination is solved for the middle row tier, the piston will raise up to signify that the second row/tier or level two has been completed. The user will then be able to rotate a third row/tier or level three, which may be the hardest level to work through to identify the correct three-color combination. Once the correct three-color combination is solved for all levels of the puzzle, the piston will raise up to signify that the last level, which may be the hardest level, has been solved. After all levels have been solved and the piston has been raised to the highest position, the user may reset the puzzle to create a new set of combinations to solve. The user may take apart the puzzle which may pull apart into pieces, for example, five pieces. Each row within the puzzle comprises cylinders with indicators that allow for users to create numerous unique combinations. In some embodiments, the puzzle may be designed and configured to allow the user to select one of a set of hundreds of thousands of unique combinations. Once the new combination is set, the user may reusable or put together the puzzle and then work through the puzzle to solve each level again. This may enable the user to play the game over and over for seemingly endless challenges and fun. In some embodiments, the user may be prevented from seeing the new combination by shielding the user's eyes when the new combination is set.

In exemplary embodiments of the present disclosure, in use the player first initiates gameplay by holding the memory puzzle with level 3 in the left hand and level 1 in the right hand. The user then may engage the puzzle by turning level 1 clockwise two times past top and bottom stopping indicators, which, for example, may be white triangles disposed on the top and bottom of the memory puzzle. After engaging the puzzle, the user may try to solve level one by "cracking the code" or finding an appropriate three-color combination to unlock the piston so it may protrude to a first level out of the memory puzzle. The puzzle is solved in a similar way to a dial lock that you would find on a gym locker. For example, the puzzle is engaged by rotating two times clockwise. The user should rotate the level housing and continue to a first selected color of a combination so that the color is centered with the white triangle, or the like. Once the first color is selected by the user, the user may then spin the level housing back counterclockwise one revolution past the first color selected. After rotating one full revolution past the white triangles, the user may move directly and select a second color of the combination so that the color is centered to the white triangle. Once the second color is selected, the user may rotate one level clockwise while going directly to a final color of the combination. At this stage, if the user did not crack the code, the user will need to reset the memory puzzle by repeating the steps above to engage the puzzle. The user may then repeat each step until the level one code is cracked and the three correct colors are selected in order. If the code is cracked for level 1, the piston will pop up to a first level of height, the user may then move onto level 2.

In accordance with embodiments of the present disclosure, to crack the color combination of level 2, the user may repeat the steps of level one. First, the user may engage the level two puzzle by repeating the steps of level one, then working to crack the code by selecting a three-color combination. The user may repeat the steps in level two until the user has cracked the level two color combination, which will unlock the piston. The piston will pop up to a second level of height to show the second level has been solved. The user may then move to level 3, or the like. To rack the color combination of level three, the steps of level one may be repeated. First, level thee may be engaged in the same manner as level one and level two. The steps in finding the three-color combination may be repeated until the user finds the cracked level 3 color combination, which will unlock the piston to a third and final height level, indicating the complete puzzle has been solved. When the complete puzzle has been solved the user may reset the codes for each level and repeat the entire process. The user may select a custom code for each level, or it may be assigned by the memory puzzle.

Figure 22:
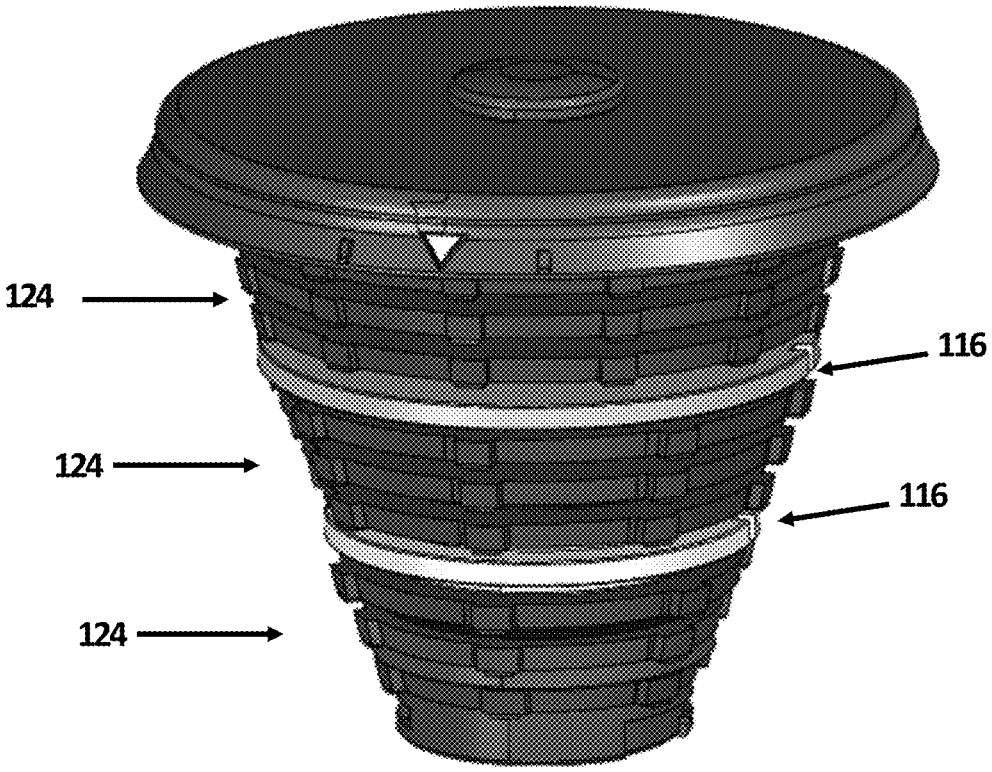
FIG. 22 depicts a perspective view of assembled sets of interior dials and level separators in accordance with embodiments of the present disclosure.
Figure 23A:
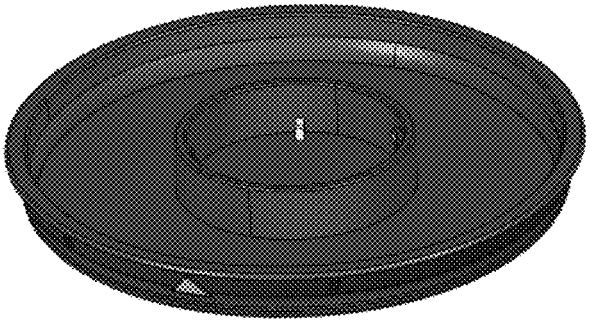
FIGS. 23*a*-23*c* depict perspective, top, and bottom views, respectively, of a bottom in accordance with embodiments of the present disclosure.
Figure 23B:
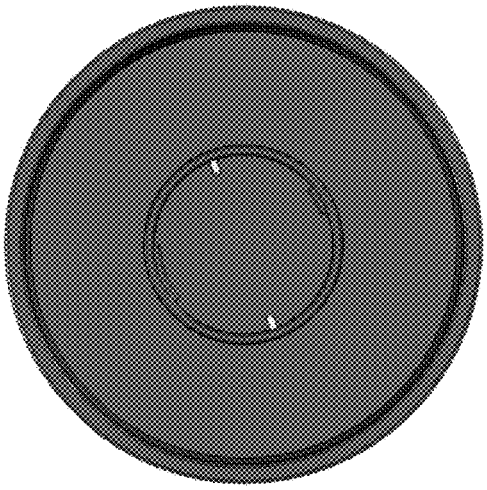
Figure 23C:
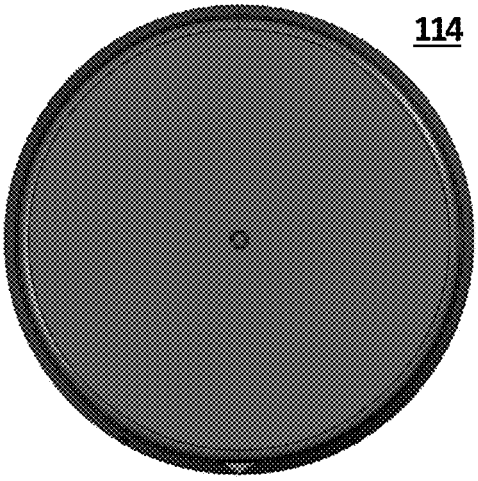
Figure 24A:
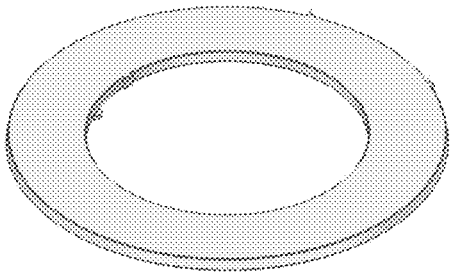
FIGS. 24*a*-24*c* depict top perspective, top, and bottom perspective views, respectively, of a level separator in accordance with embodiments of the present disclosure.
Figure 24B:
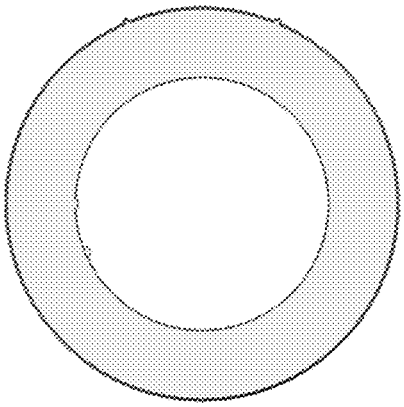
Figure 24C:
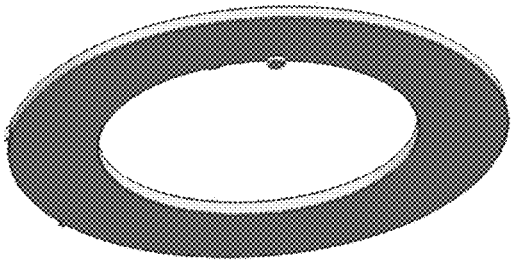
Figure 25A:
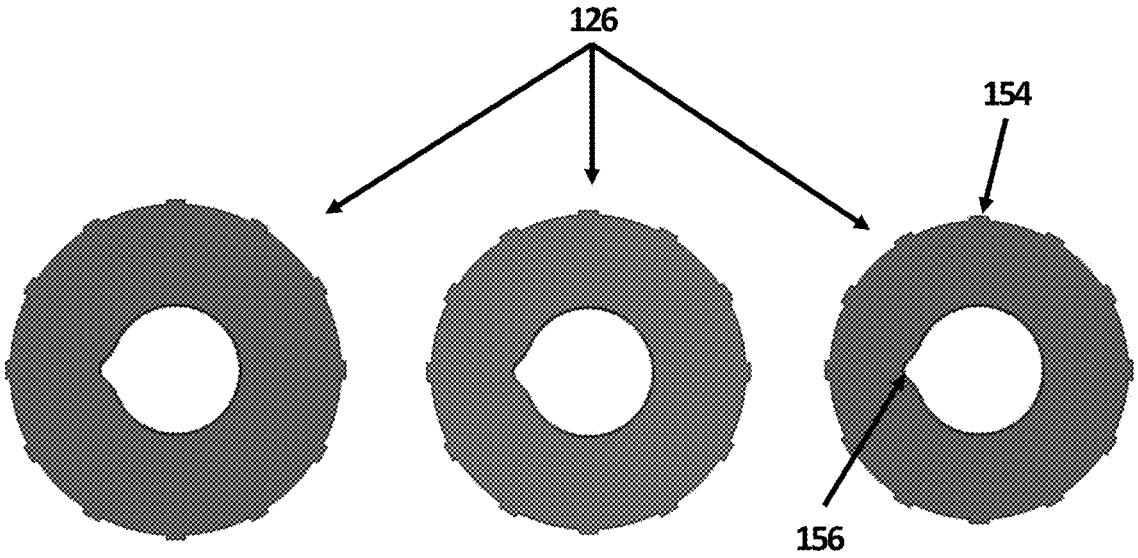
FIGS. 25*a* and 25*b* depict top and bottom views, respectively, of interior dials in accordance with embodiments of the present disclosure.
Figure 25B:
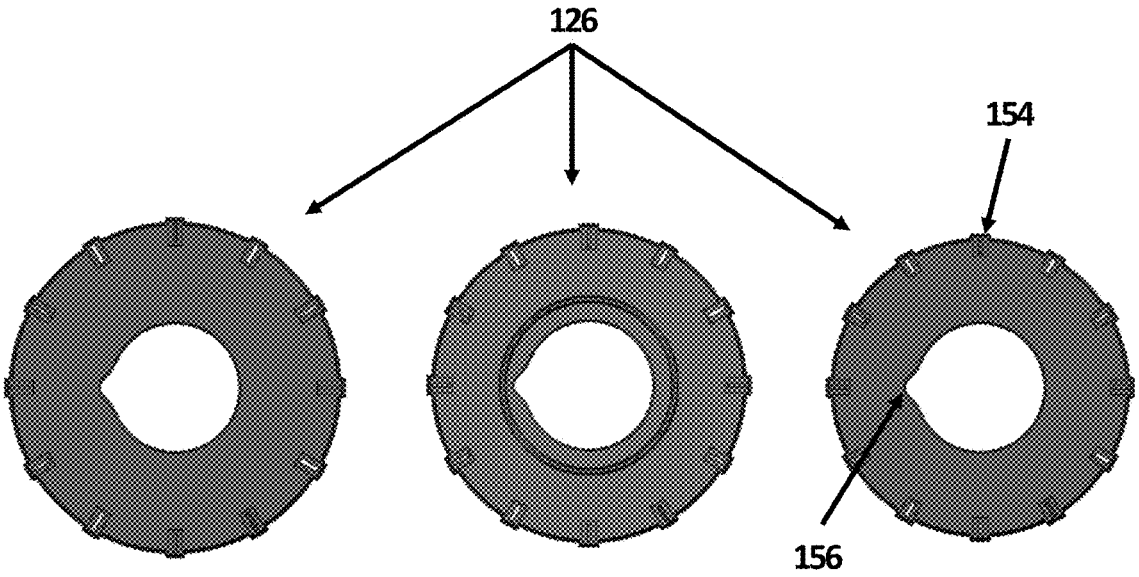

To reset the code, the user may remove the bottom by twisting it counterclockwise and removing it from the rest of the memory puzzle. The level housings, exterior dials, and space dividers may all be removed from the puzzle for all levels. For example, the level 1 housing, level 2 housing, level 3 housing and all exterior dials and space dividers may be removed. The device will then appear like it does in FIG. 22 leaving the interior dials. Each interior dial may include a notch or indicator, such as a triangle on a specific gear tooth. Each of the interior dials should then be aligned such that the gear teeth having indicators thereon are aligned with the top stopping indicator, which may be a white triangle or the like. The user may then reassemble the memory puzzle and the codes for each level will be randomly set. The user may press and hold the pin down and rotate each row a little bit and it will lock in a new puzzle.

To set you're a custom code, the user may take each of the level housings and face the color/indicator that they would like last in the sequence of the code/solution and face that toward the user. The user may then rotate the top two interior dials/gears until they stop. The user may then select a next color and select the number of spaces on the level housing between the initially selected color/indicator and the second color/indicator. The user may then move the middle interior dial/gear the same number of notches as the spaces counted between the initially selected color/indicator and the second selected color/indicator. The user may then select a third color/indicator and count the number of spaces between the second color/indicator and the third color/indicator. The user may then rotate the top gear only that number of notches. The user may repeat this for each level of the puzzle, carefully turn it over and line up the spaces with the triangle indicators. Once completely assembled, press and hold the pin and rotate the dials/level housings and the custom codes for each level are set.

FIGS. 1-5 depict various views of a memory puzzle 100 in accordance with embodiments of the present disclosure. A memory puzzle 100 may comprise one or more levels 102, 104, 106 and a piston 110. For example, a memory puzzle may comprise a level 1 102, a level 2 104, a level 106, and/or the like. Although three levels are depicted, other suitable numbers of levels are contemplated by and within the present disclosure. For example, a single level, four levels, or five levels are contemplated. Each of the levels may comprise a rotatable level housing, or the like, having puzzle spaces 103 disposed thereon. Each of the puzzle spaces 103 may comprise an indicator to distinguish it from others. For example, as depicted in the figures, different colors may be used to indicate different puzzle spaces 103. It is contemplated by and within embodiments of the present disclosure that other indicators, such as text, images, logos, markings, and/or the like may be used to differentiate the puzzle spaces 103. For clarity of illustration, only three puzzle spaces 103 are labeled in FIG. 1, however each of the similarly situated spaces on each of the levels 102, 104, and 106 are all puzzle spaces 103 in this example. So as not to obscure the illustrations, when there are multiple copies or variations of the same feature or part, only one or several of those features or part are labeled in the figures herein. For example, in FIG. 1 there are at least 14 visible puzzle spaces, but only 3 are labeled so as not to obscure the illustration with repetitive labeling.

Figure 26A:
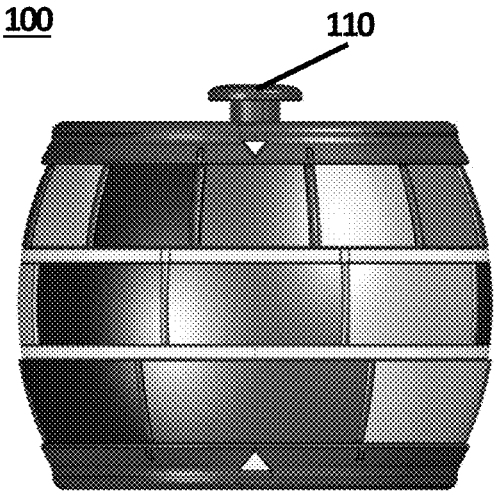
FIGS. 26*a*-26*c* depict front views of a memory puzzle after different levels of the puzzle are solved in accordance with embodiments of the present disclosure.
Figure 26B:
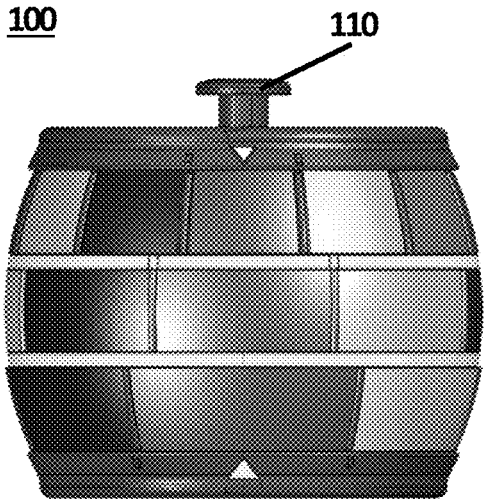
Figure 26C:
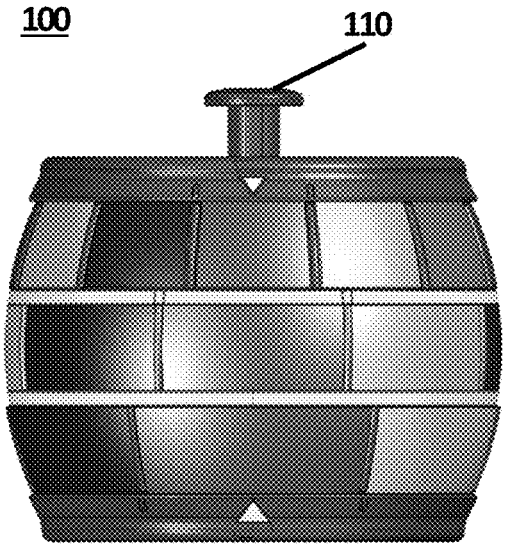

To set up the memory puzzle 100 for playing by a user, a combination may be set for each of the levels 102, 104, 106. To begin solving the puzzle 100, the user may start by attempting to solve the first level 102. A method for solving each level is described above. The dial on each level 102, 104, 106 is turned until a first puzzle space indicator 103 aligned with a top and/or bottom stopping indicator 105, 108, respectively. Externally and visually, the game is played similarly to a dial combination lock until the correct combination is discovered. When the correct combination of the first level 102 is discovered, the piston 110 may pop up at least partially (see FIG. 26*a*). The user may move on in the game and attempt to solve the second/middle level 104. After the second level 104 is solved, the piston 110 may pop up again at a higher level (see FIG. 26*b*). The user may then attempt a third/top level 106 of the puzzle. After the third level 106 is solved the piston may pop up again to a highest level (see FIG. 26*c*) and the game is over, the puzzle is solved. The user may then select new combinations for each level 102, 104, 106 or they may be mechanically assigned by the memory puzzle 100. In some embodiments, the new combinations are automatically selected without user input at the end of each game by the memory puzzle 100. Although the puzzle 100 depicted in the figures has a generally round/barrel or oval shape, other shapes are contemplated by embodiments of the present disclosure. For example, a square, rectangle, circle, pyramid, and/or the like may be used. Although the figures show a mechanical version of the puzzle 100, it is contemplated that the internal components may be partially or completely electronic but the method of solving the puzzle via actuating the dials, or the like, would remain the same.

Figure 6:
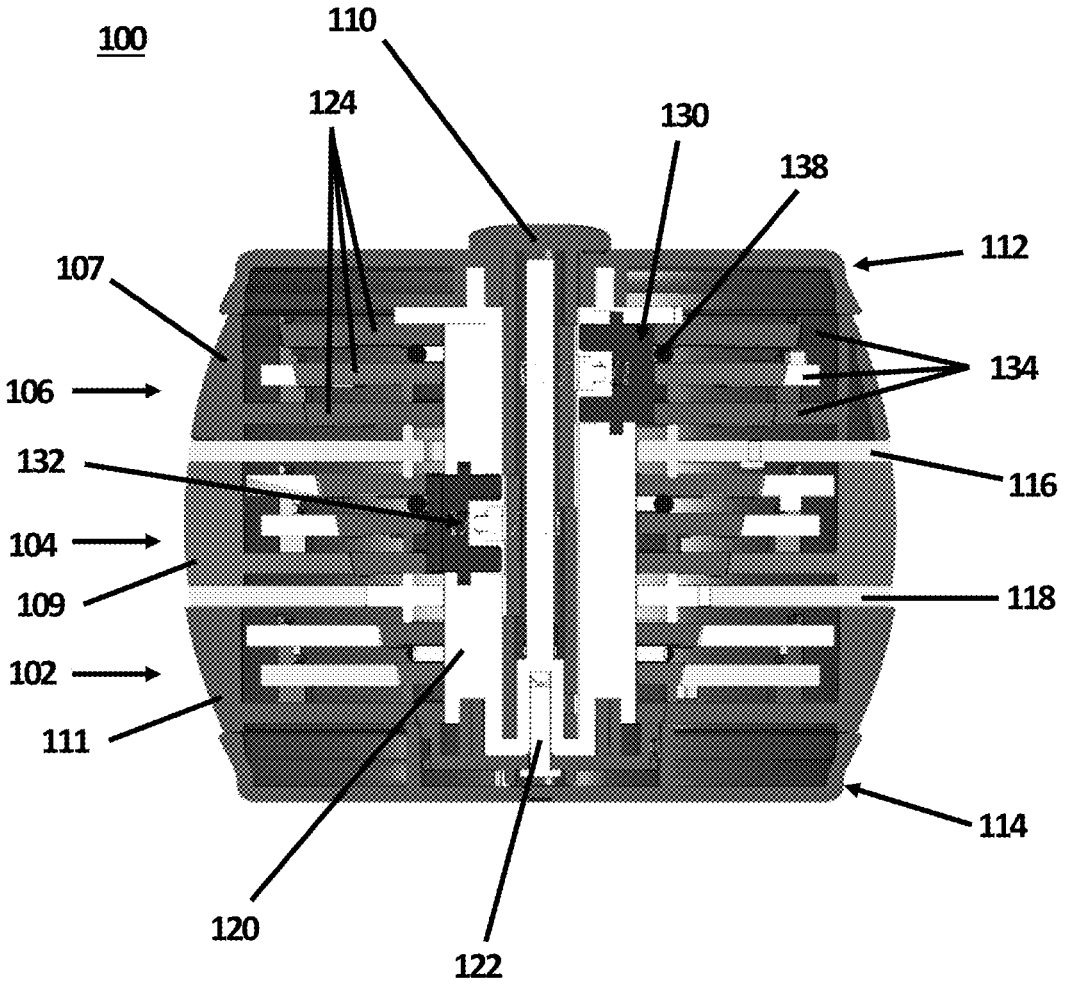
FIG. 6 depicts a cross-section view of the memory puzzle depicted in FIG. 1 along line A-A in the direction of the arrows.
Figure 7:
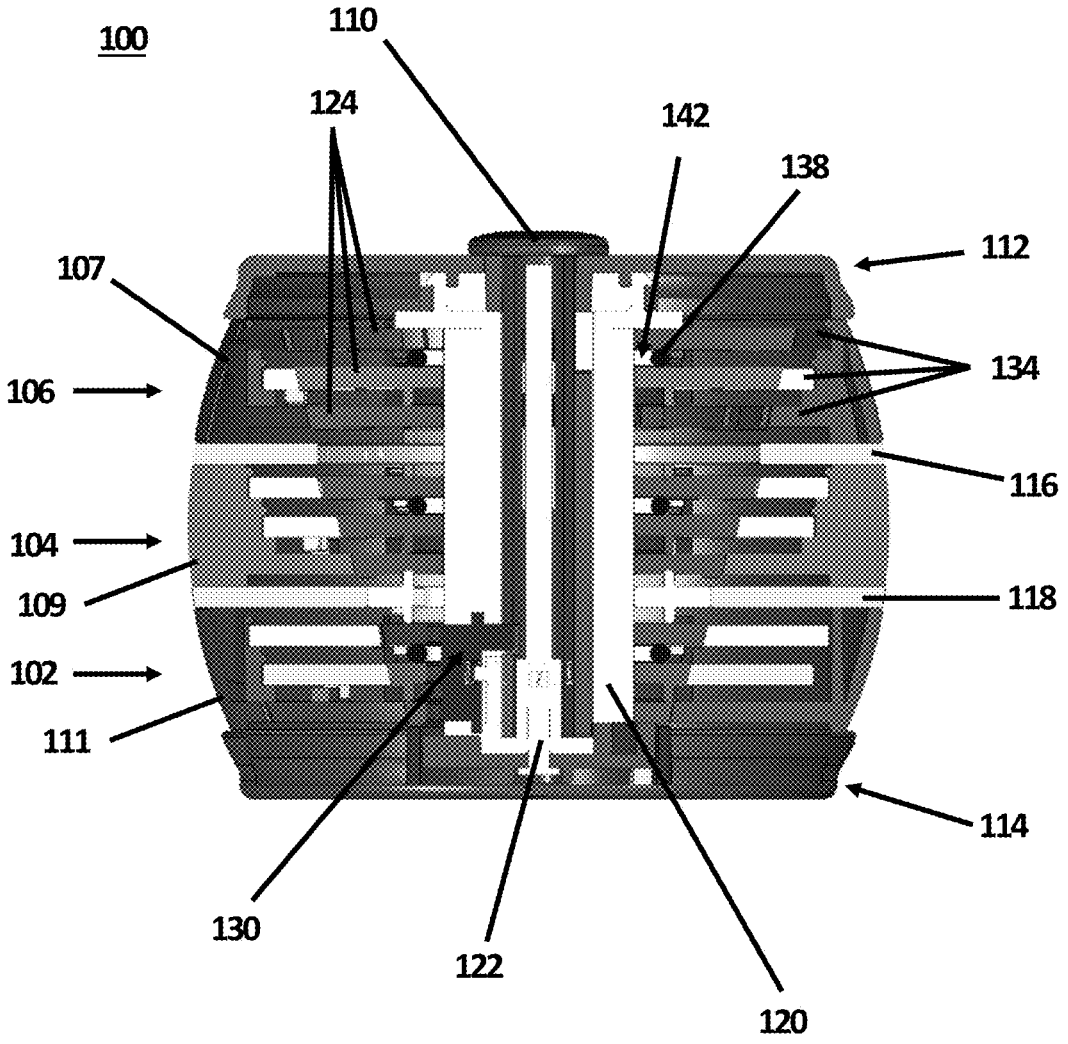
FIG. 7 depicts a cross-section view of the memory puzzle depicted in FIG. 1 along line B-B in the direction of the arrows.
Figure 8:
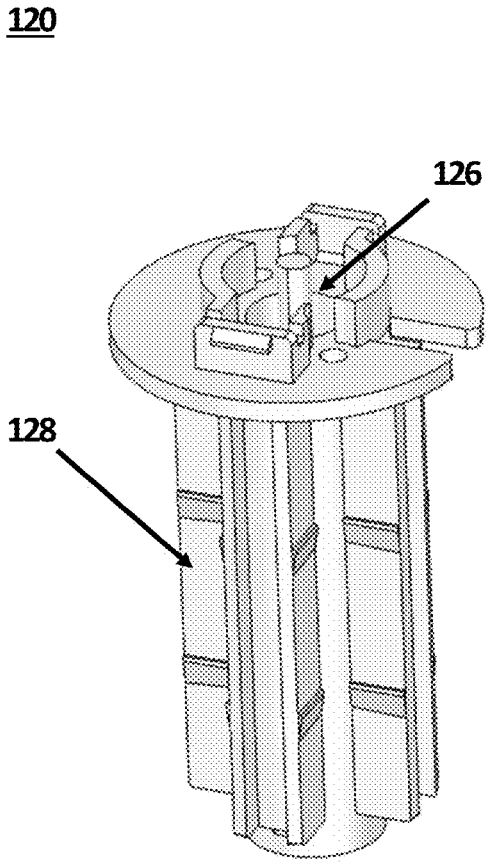
FIG. 8 depicts a perspective view of a piston housing in accordance with embodiments of the present disclosure.
Figure 9A:
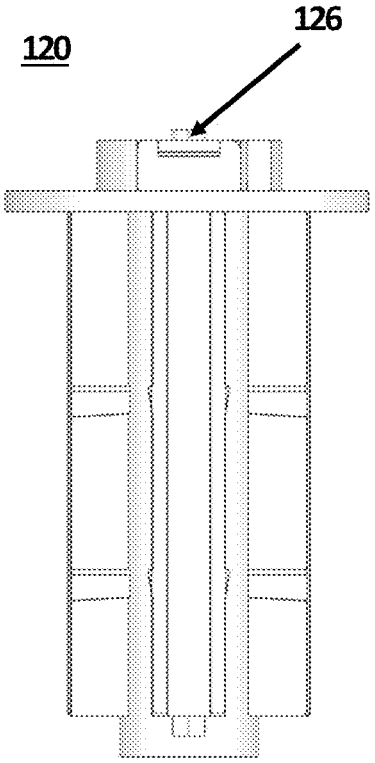
FIG. 9*a* depicts a front view of the piston housing of FIG. 8.
Figure 9B:
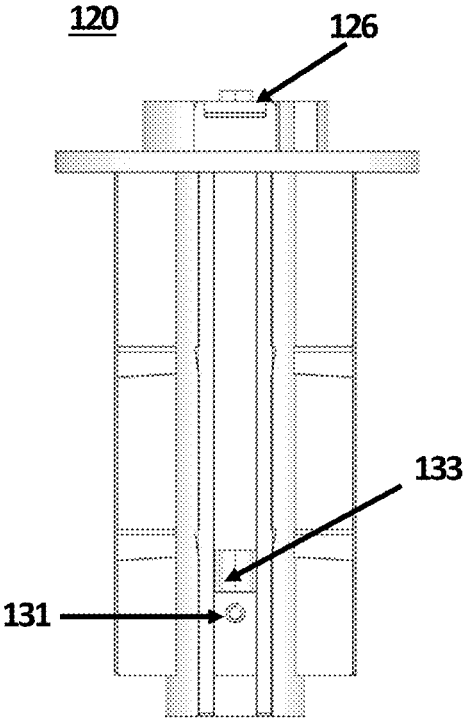
FIG. 9*b* depicts a back view of the piston housing of FIG. 8.
Figure 10A:
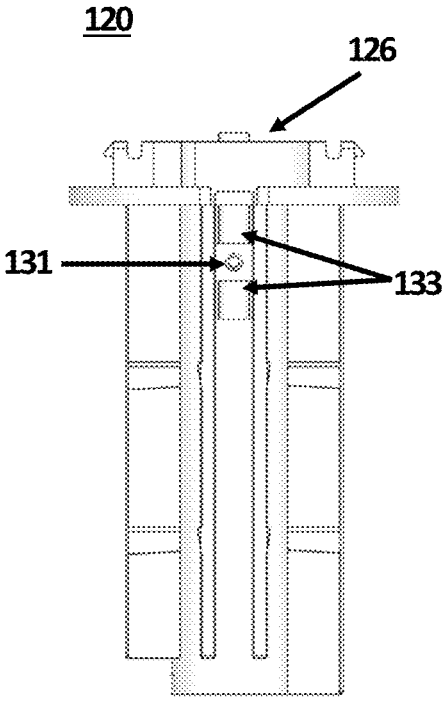
FIG. 10*a* depicts a right side view of the piston housing of FIG. 8.
Figure 10B:
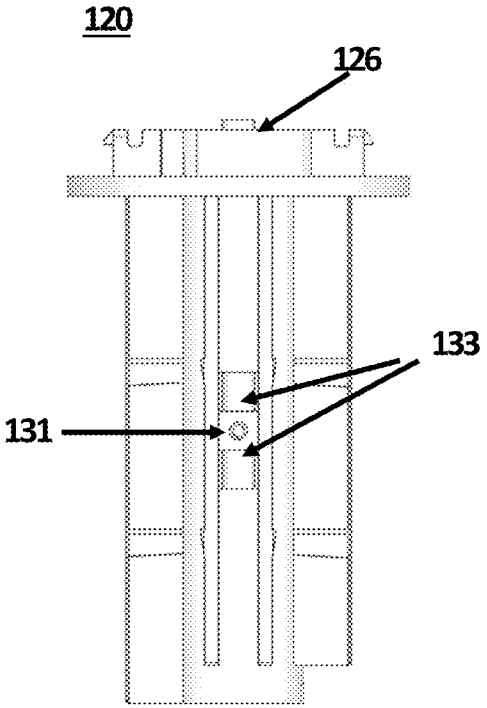
FIG. 10*b* depicts a left side view of the piston housing of FIG. 8.
Figure 11A:
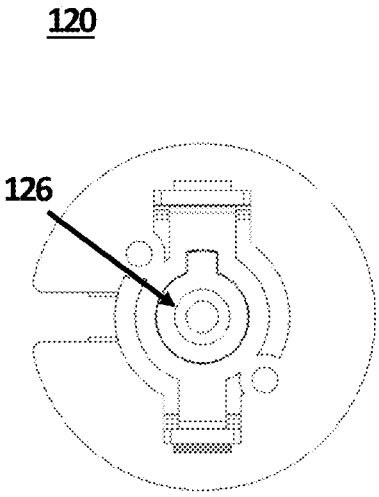
FIG. 11*a* depicts a top view of the piston housing of FIG. 8.
Figure 11B:
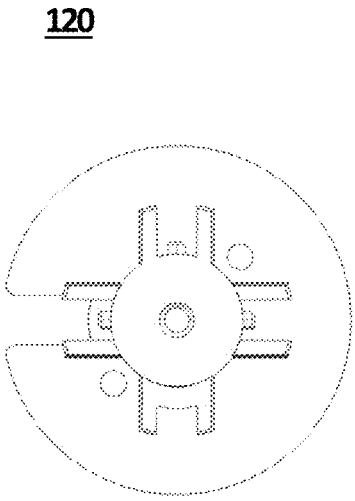
FIG. 11*b* depicts a bottom view of the piston housing of FIG. 8.

FIG. 6 depicts a cross-section view of the memory puzzle depicted in FIG. 1 along line A-A in the direction of the arrows. FIG. 7 depicts a cross-section view of the memory puzzle depicted in FIG. 1 along line B-B in the direction of the arrows. The memory puzzle 100 may comprise internal dials 124 and corresponding external dials 134. In accordance with exemplary embodiments, when solving the puzzle 100, the user may rotate the level housings 107, 109, 111 in a manner similar to a dial lock. By doing so the internal dials 124 will also move. The puzzle 100 may also comprise a piston key 130 and a piston 110. When the external dials 134 cause all internal dials 124 to be aligned such that the combination is correct, the key will move within a piston slot 156 in the interior dials 124 and release the pin 110 so that it may be moved upward by a spring or other upward biased force. When the pin 110 is released at least one level puzzle 100 is solved and the user can move on to the next level. The puzzle may comprise one or more O-rings 138 that may be secured in O-ring housings 142. The O-rings 138 may tune the smoothness of how the dials turn and give it a desired feel for the user.

Figure 12:
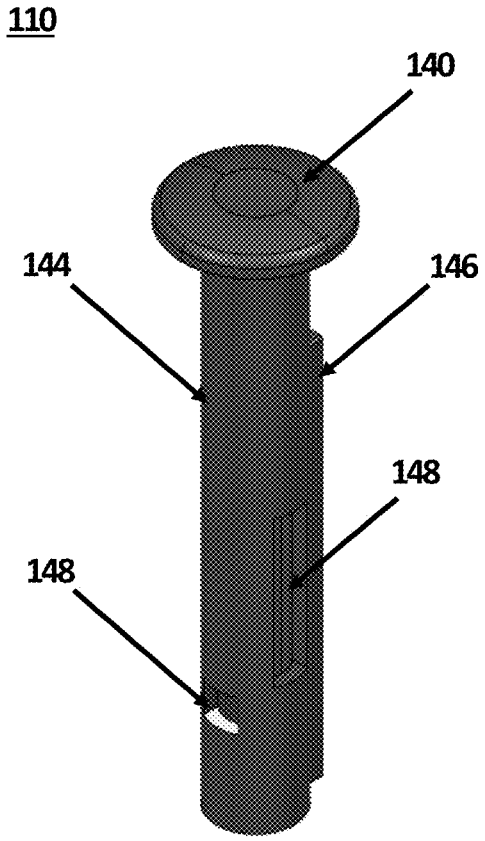
FIG. 12 depicts a perspective view of a piston in accordance with embodiments of the present disclosure.
Figure 13A:
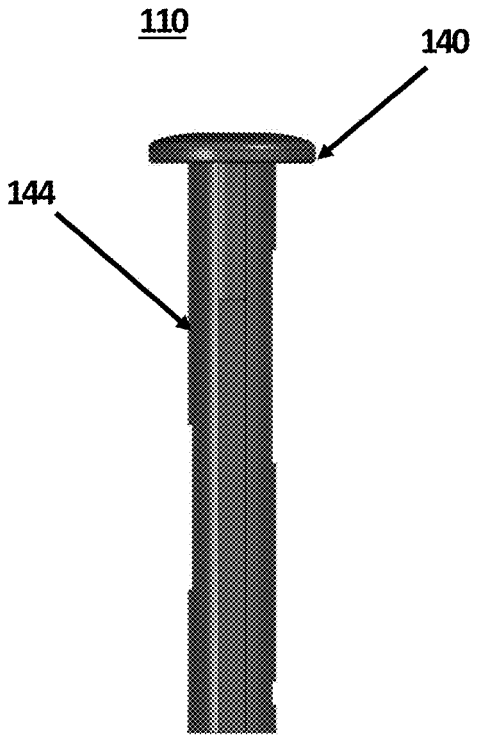
FIG. 13*a* depicts a front view of the piston of FIG. 12.
Figure 13B:
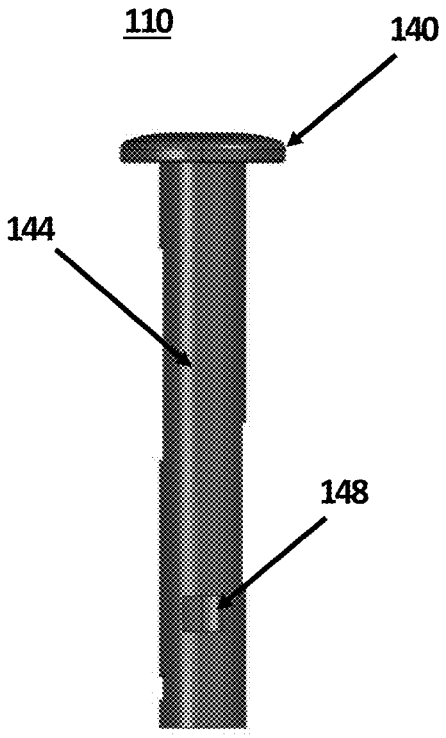
FIG. 13*b* depicts a back view of the piston of FIG. 12.
Figure 14A:
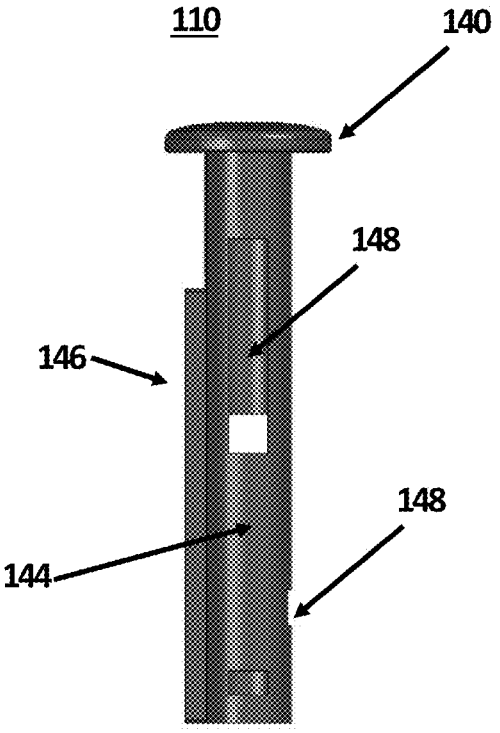
FIG. 14*a* depicts a right side view of the piston of FIG. 12.
Figure 14B:
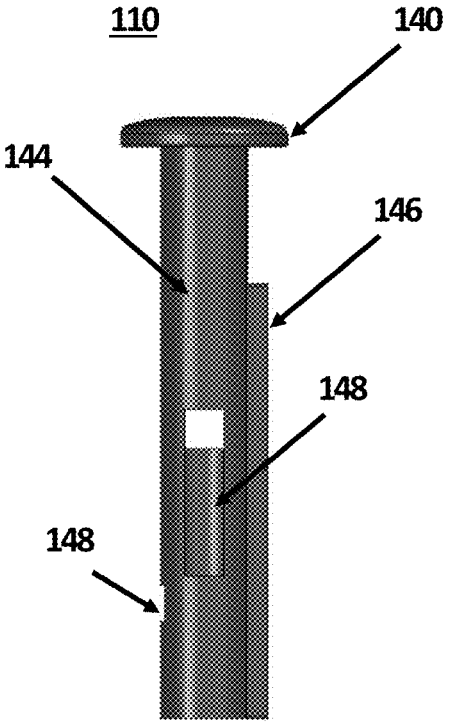
FIG. 14*b* depicts a left side view of the piston of FIG. 12.
Figure 15A:
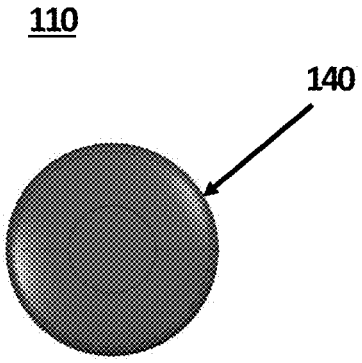
FIG. 15*a* depicts a top view of the piston of FIG. 12.
Figure 15B:
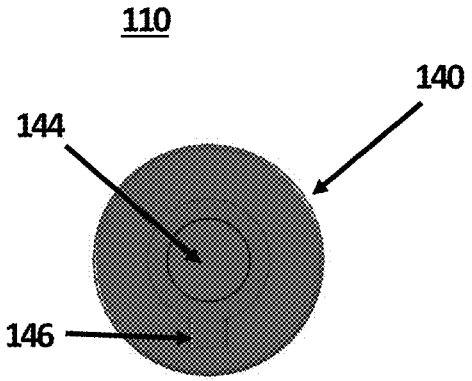
FIG. 15*b* depicts a bottom view of the piston of FIG. 12.
Figure 16:
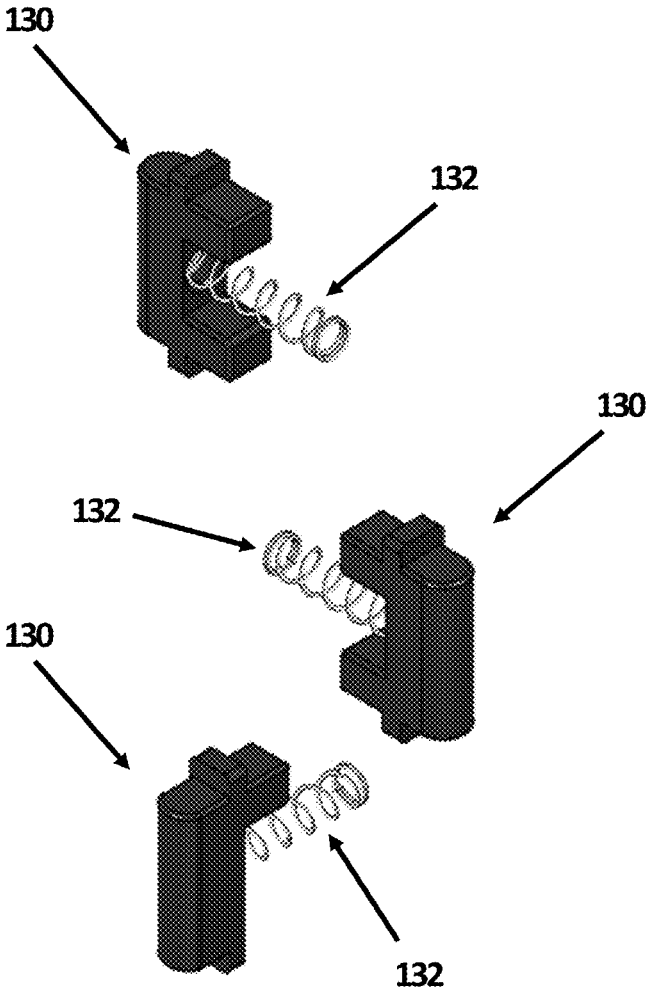
FIG. 16 depicts piston keys and springs in accordance with exemplary embodiments of the present disclosure.
Figure 17A:
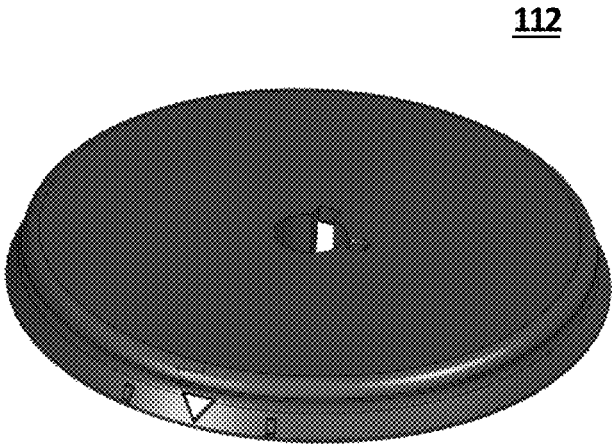
FIGS. 17*a*-17*c* depict perspective, top, and bottom views, respectively, of a top in accordance with embodiments of the present disclosure.
Figure 17B:
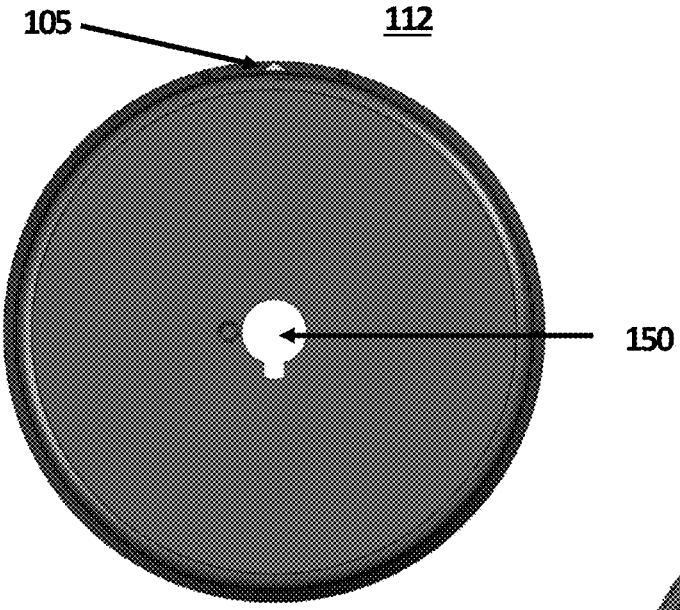
Figure 17C:
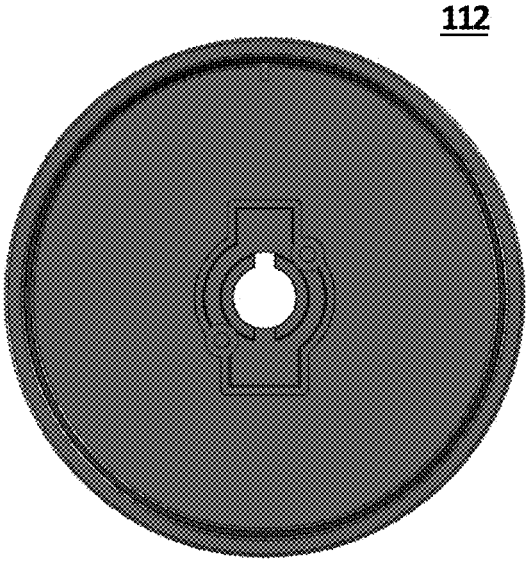
Figure 18A:
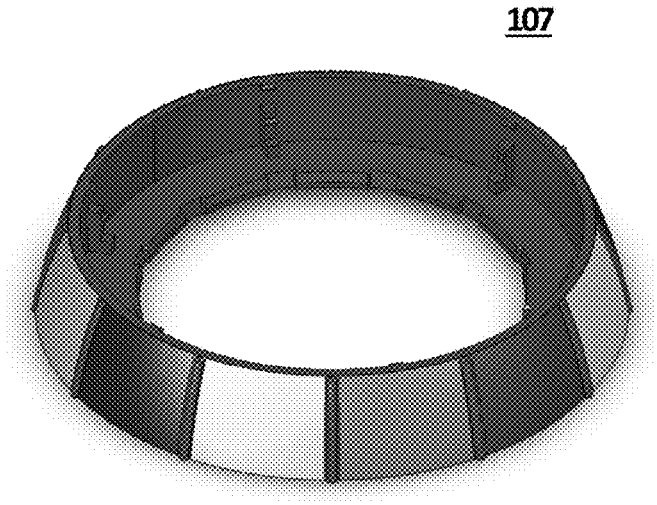
FIGS. 18*a*-18*c* depict perspective, top, and bottom views, respectively, of a level 3 housing in accordance with embodiments of the present disclosure.
Figure 18B:
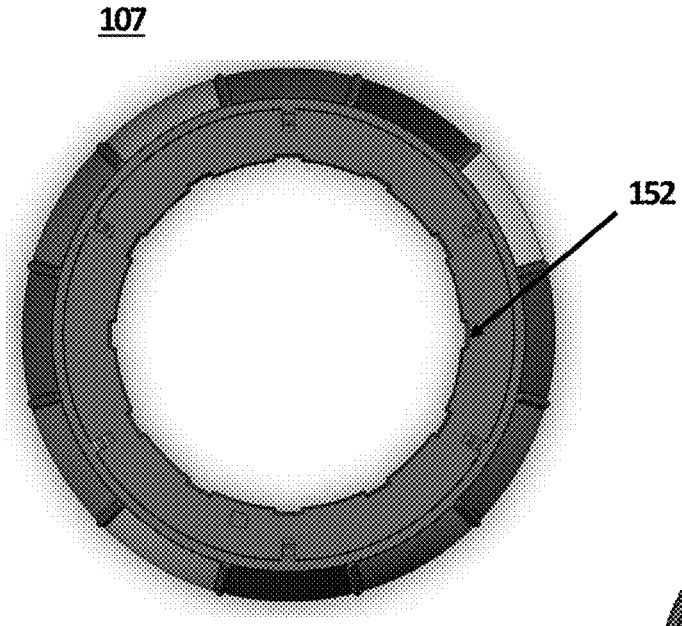
Figure 18C:
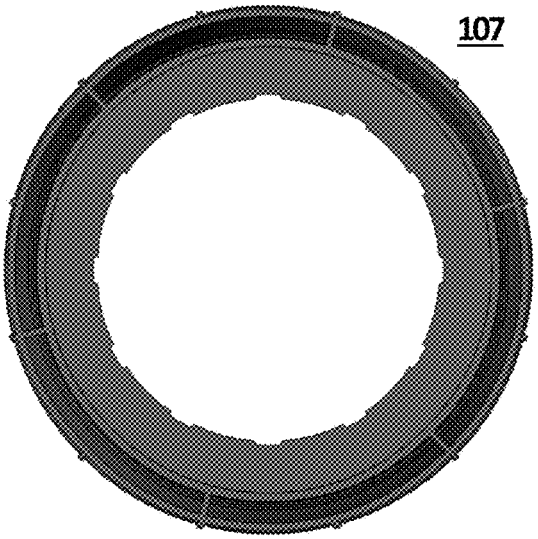
Figure 19A:
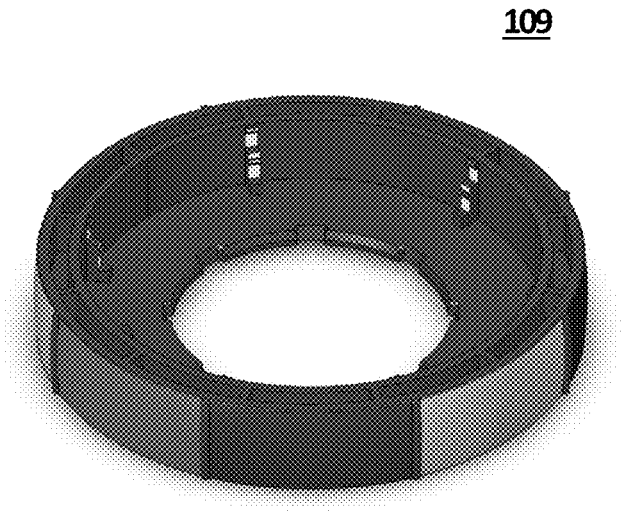
FIGS. 19*a*-19*c* depict perspective, top, and bottom views, respectively, of a level 2 housing in accordance with embodiments of the present disclosure.
Figure 19B:
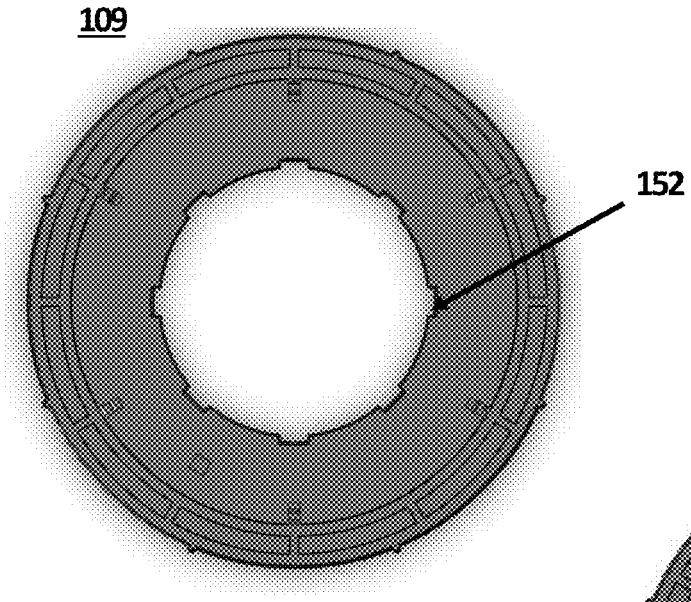
Figure 19C:
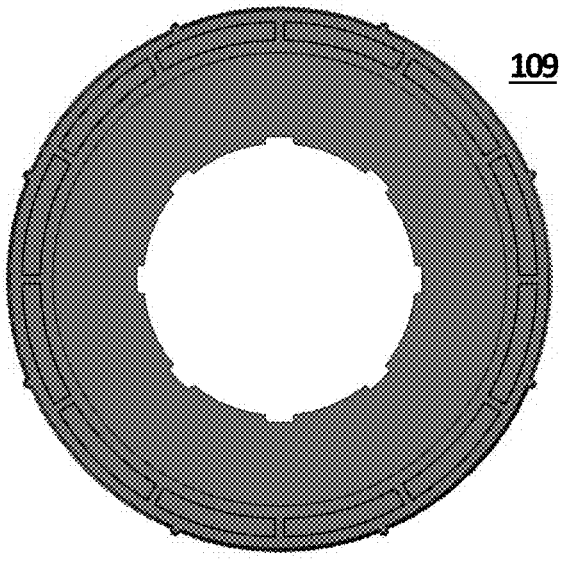
Figure 20A:
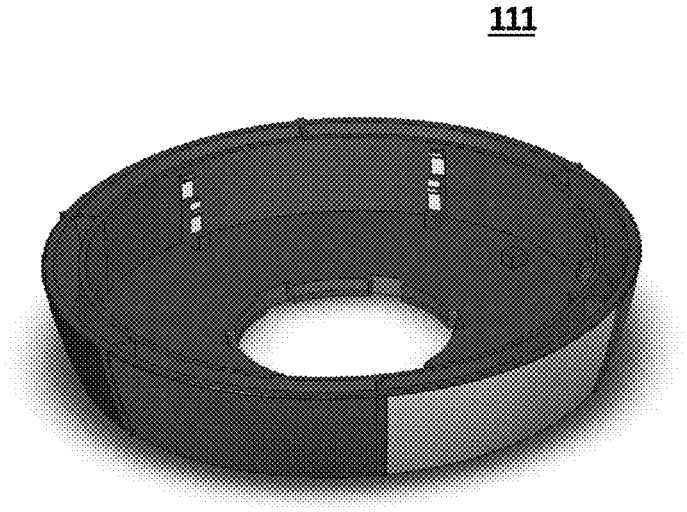
FIGS. 20*a*-20*c* depict perspective, top, and bottom views, respectively, of a level 1 housing in accordance with embodiments of the present disclosure.
Figure 20B:
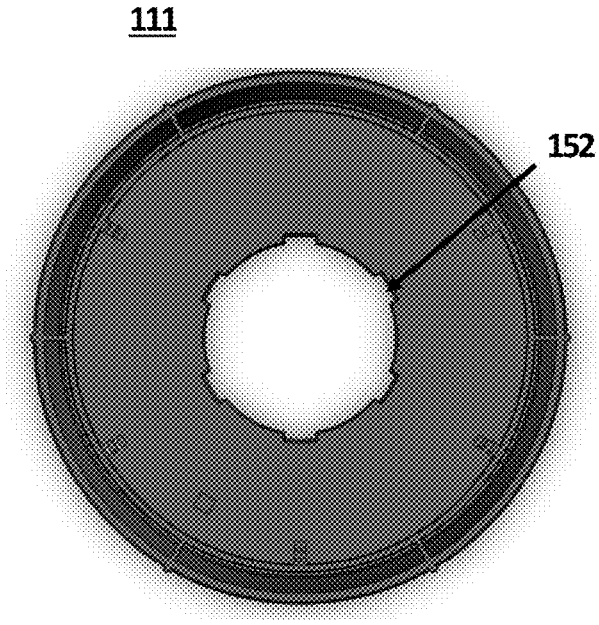
Figure 20C:
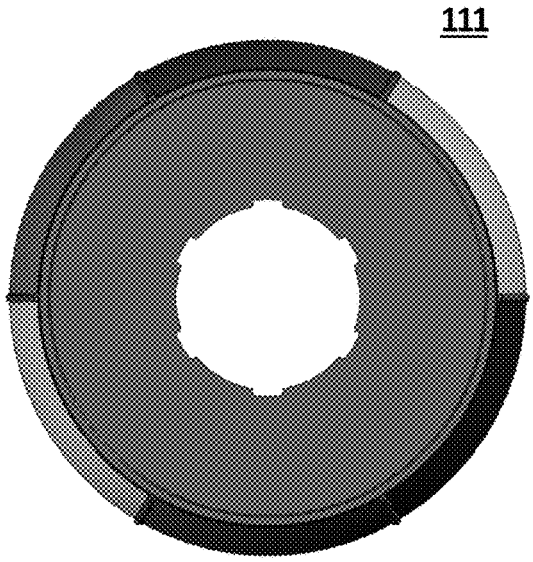
Figure 21:
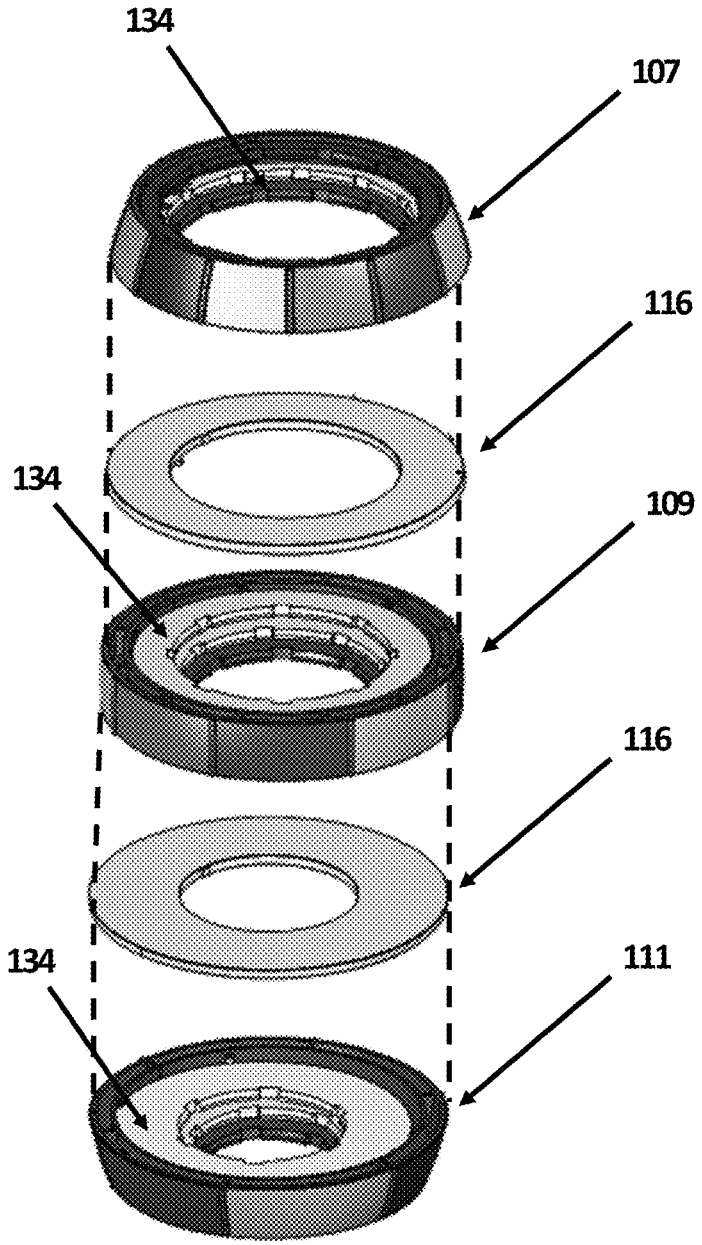
FIG. 21 depicts an exploded view of a level 3 housing, a level 2 housing, a level 1 housing, and level separators in accordance with embodiments of the present disclosure.

FIGS. 8-11 depict views of a piston housing 120 in accordance with embodiments of the present disclosure. The piston housing 120 houses the piston 110 and guides it in the correct direction upwardly out of the memory puzzle 100 when the puzzle levels are solved. The piston housing 120 also houses the piston keys 130 that hold the piston 110 into position until the interior dials 124 are properly aligned. The piston housing 120 comprises a piston slot for the piston 110, a stabilizing fin 128, and FIG. 12 depicts a perspective view of a piston in accordance with embodiments of the present disclosure;

FIGS. 13-26 comprise various views of the components depicted in the figures. For example the following features are depicted in the figures: 100 memory puzzle

102 Level 1
103 Puzzle spaces
104 Level 2
105 top stopping indicator
106 Level 3
107 Level 3 housing
108 bottom stopping indicator
109 Level 2 housing
110 Pistion
111 Level 1 housing
112 Top
114 Bottom
115 Space divider
116 Level separators
120 Piston housing
122 T-Pin
124 Interior Dials
126 Piston slot
128 Stablizing fin
130 Piston key
131 Spring housing
132 Spring
133
134 Exterior dials
136 Housing key aperture

138 O-ring
140 Piston cap
142 O-ring housing
144 Piston shaft
146 Piston fin
148 Pistion key aperture
150 Piston aperture
152 Gear Slots
154 Gear Teeth
156 Piston slot.

While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. A memory puzzle comprising:

two or more levels of rotatable level housing, each of the two or more levels having a different number of possible solutions, thereby creating different levels of difficulty for each of the two or more levels;

a number of puzzle spaces disposed on the rotatable level housings; and a piston for indicating that a portion of the puzzle has been solved, the piston disposed through a top of the memory puzzle, wherein the piston raises from an initial level flush with the top to a higher level each time a level of the one or more levels of the rotatable level housing is solved;

wherein the puzzle is solved when a code is achieved by rotating the rotatable level housings in a specific pattern.

2. The memory puzzle of claim 1, comprising three levels, each of the three levels comprising a different level of difficulty.

3. The memory puzzle of claim 1, wherein each of the puzzle spaces comprise an indicator to distinguish each of the puzzle spaces from other puzzle spaces on the same level.

4. The memory puzzle of claim 1, wherein each of the two or more levels of rotatable level housing are stacked in a vertical configuration, wherein an uppermost level is more difficult to solve than a lowermost level.

* * * * *